US009288846B2

(12) United States Patent
Ogasawara et al.

(10) Patent No.: US 9,288,846 B2
(45) Date of Patent: Mar. 15, 2016

(54) INDUCTION COOKER AND METHOD OF OPERATION

(75) Inventors: Fumitaka Ogasawara, Hyogo (JP); Takashi Takehira, Hyogo (JP); Masashi Kinoshita, Hyogo (JP); Yuji Yamamoto, Hyogo (JP)

(73) Assignee: PANASONIC INTELLECTUAL PROPERTY MANAGEMENT CO., LTD, Osake (JP)

( * ) Notice: Subject to any disclaimer, the term of this patent is extended or adjusted under 35 U.S.C. 154(b) by 639 days.

(21) Appl. No.: 13/642,450

(22) PCT Filed: Jun. 10, 2011

(86) PCT No.: PCT/JP2011/003305

§ 371 (c)(1),
(2), (4) Date: Oct. 19, 2012

(87) PCT Pub. No.: WO2011/155219

PCT Pub. Date: Dec. 15, 2011

(65) Prior Publication Data

US 2013/0037535 A1 Feb. 14, 2013

(30) Foreign Application Priority Data

Jun. 10, 2010 (JP) ..... 2010-133360

(51) Int. Cl.
*H05B 6/12* (2006.01)
*H05B 6/06* (2006.01)

(52) U.S. Cl.
CPC ..... *H05B 6/062* (2013.01)

(58) Field of Classification Search
CPC ..... H05B 6/062
USPC ..... 219/200, 385, 391, 438, 441, 482, 490, 219/497, 494, 600, 618, 620, 622, 625, 660, 219/661, 663, 665; 99/324, 325, 330, 331, 99/332, 333, 342, 352, 403
See application file for complete search history.

(56) References Cited

U.S. PATENT DOCUMENTS

2005/0247696 A1* 11/2005 Clothier ..... 219/497

FOREIGN PATENT DOCUMENTS

CN 101444138 A 5/2009
JP 2005-158651 A 6/2005

(Continued)

OTHER PUBLICATIONS

Office Action from Chinese Application No. 201180019818.2, dated Apr. 3, 2014 (with English translation of Search Report), 7 pages.

(Continued)

*Primary Examiner* — Dana Ross
*Assistant Examiner* — Joseph Iskra
(74) *Attorney, Agent, or Firm* — Brinks Gilson & Lione

(57) ABSTRACT

An induction heating cooker includes a boiling over detecting portion that reduces the heating output of an inverter to a predetermined value when a change amount of an electrostatic capacitance detected by a capacitance detecting portion with respect to a reference value is equal to or greater than a threshold value. The boiling over detecting portion stops a heating action or reduces the heating output to a third set value lower than a second set value when a change rate of the capacitance is equal to or greater than a predetermined change rate, and maintains the heating output at the second set value when the change rate of the capacitance is less than the predetermined change rate, during a boiling over determining period started from the time that the change amount of the capacitance with respect to the reference value is equal to or greater than the output reducing threshold value.

16 Claims, 6 Drawing Sheets

(56) References Cited

FOREIGN PATENT DOCUMENTS

| | | | |
|---|---|---|---|
| JP | 2005-166392 | A | 6/2005 |
| JP | 2008-159494 | A | 7/2008 |

OTHER PUBLICATIONS

International Preliminary Report on Patentability for International Application No. PCT/JP2011/003305, dated Jan. 15, 2013, 5 pages.
International Search Report for International Application No. PCT/JP2011/003305, dated Jul. 26, 2011, 1 page.

* cited by examiner

INDUCTION COOKER AND METHOD OF OPERATION

This application is a 371 application of PCT/JP2011/003305 having an international filing date of Jun. 10, 2011, which claims priority to JP2010-133360 filed Jun. 10, 2010, the entire contents of which are incorporated herein by reference.

TECHNICAL FIELD

The present invention relates to an induction heating cooker and more particularly, to an induction heating cooker having a boiling over detecting function for detecting a boiling over state of a cooking container such as a pan at the time of cooking.

BACKGROUND ART

According to a conventional induction heating cooker, as described in Japanese Patent Laid-open Publication No. 2008-159494 (Patent Literature 1), a plurality of electrodes are provided around an outer periphery of a heating coil and a boiling over state is sensed on the basis of a change in electrostatic capacitance of the electrodes.

FIG. 5 is a view showing a configuration of the conventional induction heating cooker disclosed in the Patent Literature 1. FIG. 6 is a graph showing a change in electrostatic capacitance in the electrode used for detecting the boiling over described in the Patent Literature 1.

As shown in FIG. 5, the conventional induction heating cooker is provided with a drive circuit 102 for receiving a low-frequency power from an AC power supply 101 and supplying a high-frequency power to a heating coil 104 to heat a cooking container (not shown) by induction. In addition, a plurality of electrodes 103 each having a shape of a small circular plate are concentrically dispersed around the outer periphery of the heating coil 104. Each of the dispersed electrodes 103 is connected to an electrostatic capacitance measuring circuit 106. The electrostatic capacitance measuring circuit 106 senses electrostatic capacitance between the electrode 103 and the electrostatic capacitance measuring circuit 106. Hereinafter, this electrostatic capacitance is simply referred to as "electrostatic capacitance of the electrode 103". The electrostatic capacitance of the electrode 103 depends on arrangements of a dielectric body (such as a top panel etc.) and a conductive body (such as a metal cooking container or the heating coil 104 or the like) provided around the electrode 103. According to the conventional induction heating cooker configured as described above, after a liquid has boiled over from an edge portion of the cooking container such as a pan mounted on the heating coil 104 with the top panel (top plate) interposed between them, the spilt liquid exists on any of the electrodes 103 or adjacent to it. Thus, when the spilt liquid exists, the electrostatic capacitance increases in any of the electrodes 103. The boiling over is sensed by sensing the increase in electrostatic capacitance. When the boiling over is generated in any of the electrodes 103 or adjacent to it, water exists between the electrode 103 and the cooking container or the heating coil 104, so that there is an abrupt increase in the electrostatic capacitance between the heating coil 104 and the electrode 103. Therefore, the boiling over can be sensed by sensing the electrostatic capacitance of the electrode 103 as described above.

According to the conventional induction heating cooker, when the phenomenon that the electrostatic capacitance of the electrode 103 abruptly increases is sensed (refer to FIG. 6), the control circuit 105 determines it as the boiling over, and stops an action of the drive circuit 102, or reduces the high-frequency current flowing to the heating coil 104.

PLT 1: Unexamined Japanese Patent Publication No. 2008-159494

SUMMARY OF THE INVENTION

Technical Problem

As described above, with the electrodes 103 dispersed around the outer periphery of the heating coil 104, the boiling over can be sensed by sensing its electrostatic capacitance, but the problem is that the change in electrostatic capacitance of the electrode 103 is not a phenomenon caused only by the boiling over. For example, when a user puts something containing water such as a wet kitchen cloth on the top panel near the electrode 103, the electrostatic capacitance sensed in the electrode 103 considerably changes. In addition, in a case where the user shifts a position of the cooking container, the electrostatic capacitance sensed in the electrode 103 also changes. Thus, even in the case where the boiling over is not generated, the conventional induction heating cooker determines it as the boiling over, and stops the action of the drive circuit 102, or reduces the current of the heating coil 104, so that the cooker is not user-friendly.

As for the induction heating cooker, the top panel having a smooth and flat surface as a cooking surface is provided, so that a stain generated due to the boiling over can be easily cleaned. However, in a case where the boiling over is generated in large amounts, and left unclean after the boiling over has been generated, the problem is that an upper surface of the panel or a periphery of the induction heating cooker is contaminated in a short time. In addition, even in a case where the boiling over is generated in small amounts, the problem is that it is similarly contaminated after the boiling over has continued for a long time. Therefore, when the boiling over is generated, it is important to inform a user of the fact, or stop or reduce a heating action. However, when the heating action is stopped or reduced due to erroneous sensing of the boiling over, the cooking is stopped against the intention of the user, and when the erroneous detection occurs frequently, the cooker is not user-friendly and leads to a big problem.

It is an object of the present invention to provide a user-friendly induction heating cooker capable of reducing erroneous detection of boiling over of a cooking container generated at the time of cooking, and detecting generation of the boiling over with high precision.

Solution to Problem

As for an induction heating cooker in accordance with the present invention which will be described below, signs and numeral values in parentheses are reference signs affixed to components and specific values in an embodiment which will be described below, respectively, but these show one example and do not specify the present invention.

An induction heating cooker in a first aspect of the present invention includes a top panel (2) for mounting a cooking container (1), a heating coil (3) provided under the top panel, for heating the cooking container (1) by induction, an inverter (4) for supplying a high-frequency current to the heating coil, an electrode (9) provided on a back surface of the top panel adjacent to a periphery of the heating coil, an electrostatic capacitance detecting portion (10) for supplying a high-frequency signal to the electrode and detecting electrostatic capacitance of the electrode, a memory portion (12) for storing the detected electrostatic capacitance as a reference value, and a control portion (8) for controlling the inverter such that heating output of the inverter reaches a first set value (such as 3 kW or lower);

a boiling over detecting portion (11) for executing a reference value updating process to store the electrostatic capacitance in the memory portion as the reference value when the electrostatic capacitance of the electrode satisfies a predetermined condition, and executing an output controlling action to reduce the heating output of the inverter to a predetermined second set value (such as 0.3 kW) or stop a heating action, after a change amount of the electrostatic capacitance of the electrode with respect to the reference value reaches an output reducing threshold value (such as 14 digits) or more, in which the boiling over detecting portion (11) stops the heating action or reduces the heating output to a third set value (such as 0.1 kW) lower than the second set value when a change rate of the detected electrostatic capacitance reaches a predetermined change rate (such as 145 digits/second) or more, and returns the heating output to the first set value when the change rate of the detected electrostatic capacitance is less than the predetermined change rate, during a change rate detecting period (such as 1.5 second) including the time when the change amount of the electrostatic capacitance of the electrode with respect to the reference value reaches the output reducing threshold value (such as 14 digits) or more. According to the induction heating cooker in the first aspect configured as described above, it becomes possible to considerably reduce the erroneous detection of the boiling over of the cooking container generated at the time of cooking.

According to the induction heating cooker in a second aspect of the present invention, the boiling over detecting portion in the first aspect may detect the electrostatic capacitance of the electrode a plurality of times during a first predetermined time (detecting period: such as 1 second), and calculate the change rate with the change amount of an average value of the plurality of detected electrostatic capacitance with respect to the reference value.

According to the induction heating cooker in a third aspect of the present invention, the boiling over detecting portion (11) in the first aspect may update the electrostatic capacitance detected during a first predetermined time (detecting period: such as 1 second) and stores it in the memory portion as the reference value when the change amount of the electrostatic capacitance detected during the first predetermined time with respect to the reference value is less than a reference value update stopping threshold value (such as 3 digits) smaller than the output reducing threshold value, and stop the update of the reference value to the memory portion when the change amount of the electrostatic capacitance detected during the first predetermined time (such as 1 second) with respect to the reference value reaches the reference value update stopping threshold value or more.

According to the induction heating cooker in a fourth aspect of the present invention, the boiling over detecting portion in the first aspect may detect the electrostatic capacitance of the electrode a plurality of times during a first predetermined time (detecting period: such as 1 second), and update an average value of the plurality of electrostatic capacitance detected in the first predetermined time (such as 1 second) and store it in the memory portion as the reference value when the change amount of an average value of the plurality of detected electrostatic capacitance with respect to the reference value is less than the reference value update stopping threshold value (such as 3 digits).

According to the induction heating cooker in a fifth aspect of the present invention, the boiling over detecting portion in the first aspect may detect the electrostatic capacitance of the electrode a plurality of times during a first predetermined time (detecting period: such as 1 second), and stops the update of the reference value to the memory portion when the change amount of an average value of the plurality of detected electrostatic capacitance with respect to the reference value reaches the reference value update stopping threshold value (such as 3 digits) or more.

According to the induction heating cooker in a sixth aspect of the present invention, the boiling over detecting portion in the first to fifth aspects may execute the output controlling action after a predetermined delay time from the time when the change amount of the electrostatic capacitance of the electrode with respect to the reference value reaches the output reducing threshold value (such as 14 digits) or more, and does not execute the output controlling action when it is determined that the boiling over is not generated during the delay time.

The induction heating cooker in a seventh aspect of the present invention further includes the plurality of electrodes (9), and the boiling over detecting portion in the first aspect returns the heating output to the first set value when the change rate of the electrostatic capacitance in any one of the electrodes reaches the predetermined change rate or more, and the change amounts of other electrodes with respect to the reference value all reach a boiling over detecting canceling threshold value (such as 8 digits) or more set to be equal to or lower than the output reducing threshold value.

According to the induction heating cooker in an eighth aspect of the present invention, the boiling over detecting portion in the first aspect does not execute the output controlling action to be performed when the change amount of the electrostatic capacitance of the electrode with respect to the reference value reaches the output reducing threshold value or more, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value reaches the output reducing threshold value (such as 14 digits) or more.

Advantageous Effects of the Invention

The present invention can provide the induction heating cooker which is high in reliability and safety because it can considerably reduce the erroneous detection of the boiling over of the cooking container generated at the time of cooking, surely detect the generation of the boiling over.

DETAILED DESCRIPTION OF THE PREFERRED EMBODIMENTS

Hereinafter, a specific embodiment according to an induction heating cooker in the present invention will be described with reference to the accompanied drawings. In addition, the present invention is not limited to a specific configuration described in the following embodiment, and includes a configuration provided on the basis of a technical idea similar to a technical idea which will be described in the embodiment, and technical common knowledge in the art.

First Embodiment

Figure 1A:
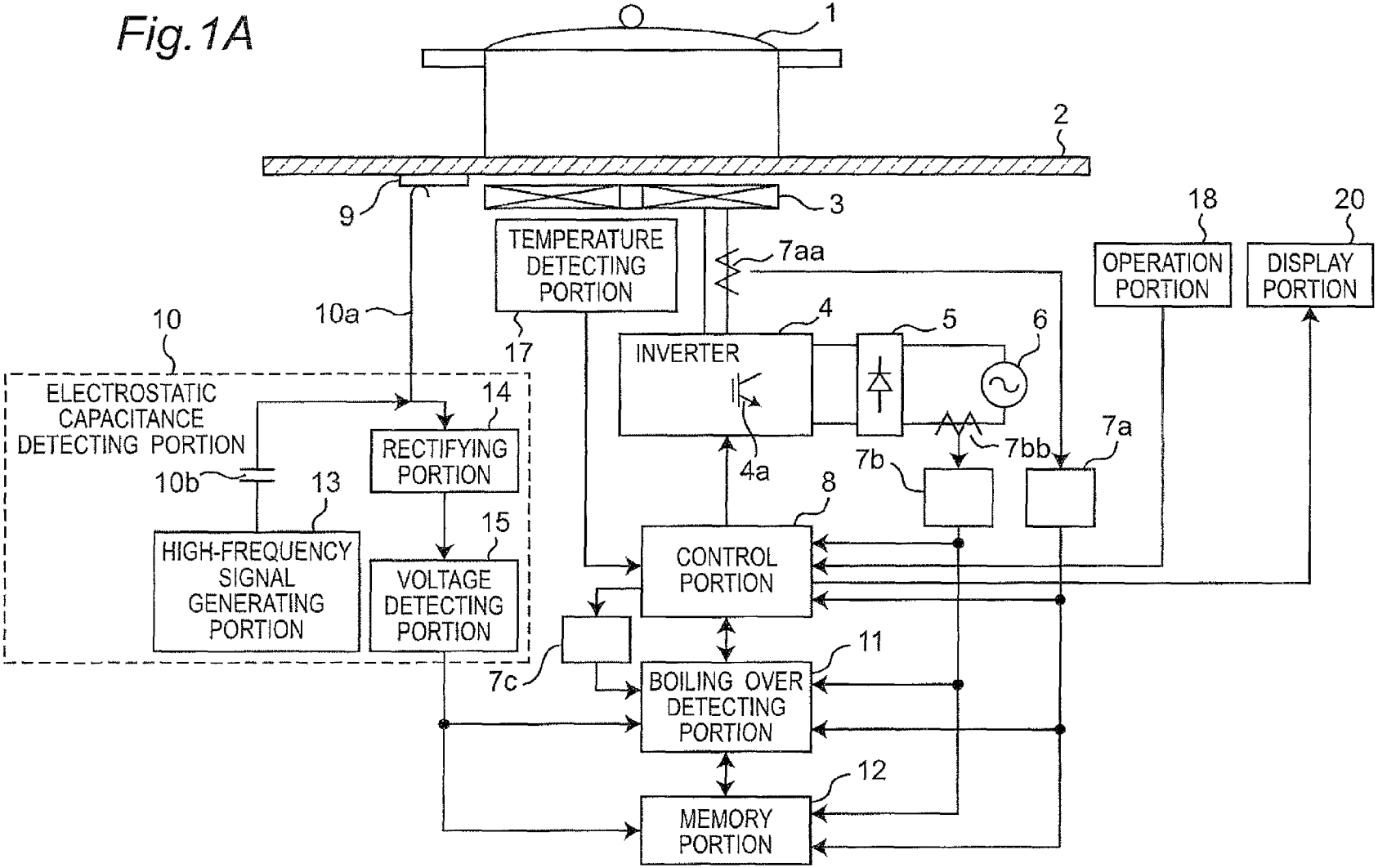
FIG. 1A is a block diagram showing a configuration of an induction heating cooker in a first embodiment according to the present invention.
Figure 1B:
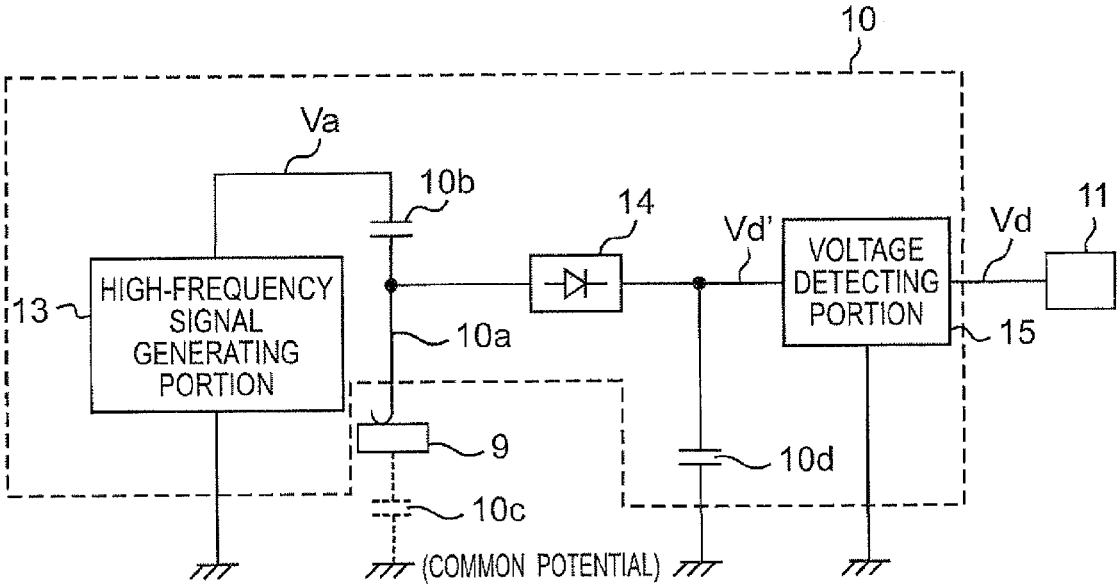
FIG. 1B is a block diagram showing a configuration of an electrostatic capacitance detecting portion of the induction heating cooker in the first embodiment.

FIG. 1A is a block diagram showing a configuration of an induction heating cooker in a first embodiment according to the present invention. FIG. 1B is a circuit diagram showing a configuration of an electrostatic capacitance detecting portion in the induction heating cooker in the first embodiment. Referring to FIG. 1A, the induction heating cooker in the first embodiment has a top panel (top plate) 2 on which a cooking container (such as an iron pan) 1 is mounted, a heating coil 3 provided under the top panel 2, for generating a high-frequency magnetic field when a high-frequency current is supplied and heating a bottom surface of the oppositely arranged cooking container 1 by induction, an inverter 4 including one or more switching elements 4*a* such as IGBTs, for supplying the high-frequency current to the heating coil 3, a rectifier 5 for rectifying an AC power supply 6 and supplying a DC current to the inverter 4, a current transformer 7*aa* for monitoring a heating coil current flowing in the heating coil 3, heating coil current detecting portion 7*a* serving as a load movement detecting portion for detecting the heating coil current (high-frequency current) corresponding to a heating output of the inverter 4, a current transformer 7*bb* for monitoring an input current of the inverter 4, an input current detecting portion 7*b* serving as a load movement detecting portion for receiving an output signal of the current transformer 7*bb* and detecting the input current (low-frequency current) corresponding to the heating output of the inverter 4, a turn-on time detecting portion 7*c* for monitoring a turn-on time of the switching element 4, a control portion 8 for driving the inverter 4 so that the heating output is varied on the basis of a heating coil current detecting signal outputted from the heating coil current detecting portion 7*a* and an input current detecting signal outputted from the input current detecting portion 7*b*, a plurality of electrodes 9 formed of a material having preferable conductivity and printed into a band-shaped pattern on a back surface of the top panel 2 (opposite surface of the surface on which the cooking container 1 is set, in FIG. 1A), an electrostatic capacitance detecting portion 10 for detecting electrostatic capacitance of each electrode 9, a memory portion 12 for storing a magnitude of the electrostatic capacitance detected by the electrostatic capacitance detecting portion 10, a magnitude of the heating coil current detected by the heating coil current detecting portion 7*a* at predetermined intervals, and a magnitude of the input current detected by the input current detecting portion 7*b* at predetermined intervals, and a boiling over detecting portion 11 for detecting a boiling over state of the cooking container 1 on the basis of an electrostatic capacitance detecting signal and a heating output detecting signal (including the heating coil current detecting signal or the input current detecting signal). In addition, the term "detecting the electrostatic capacitance of the electrode" means "detecting a magnitude of the electrostatic capacitance between a predetermined potential (such as a common potential or an earth potential of the electrostatic capacitance detecting portion 10) and the electrode. In addition, as for the induction heating cooker in the first embodiment, a configuration and a function for detecting the boiling over state of the cooking container 1 will be mainly described, and a function and a configuration for detecting other states such as shifting, lifting, or burning of the cooking container 1, or putting of a load of a small article such as a knife or a folk on the top panel 2, that is, a function for detecting the state other than the boiling over state is not described, and components other than the components required for describing the configuration for detecting the boiling over state are omitted in the block diagram in FIG. 1A.

Figure 2:
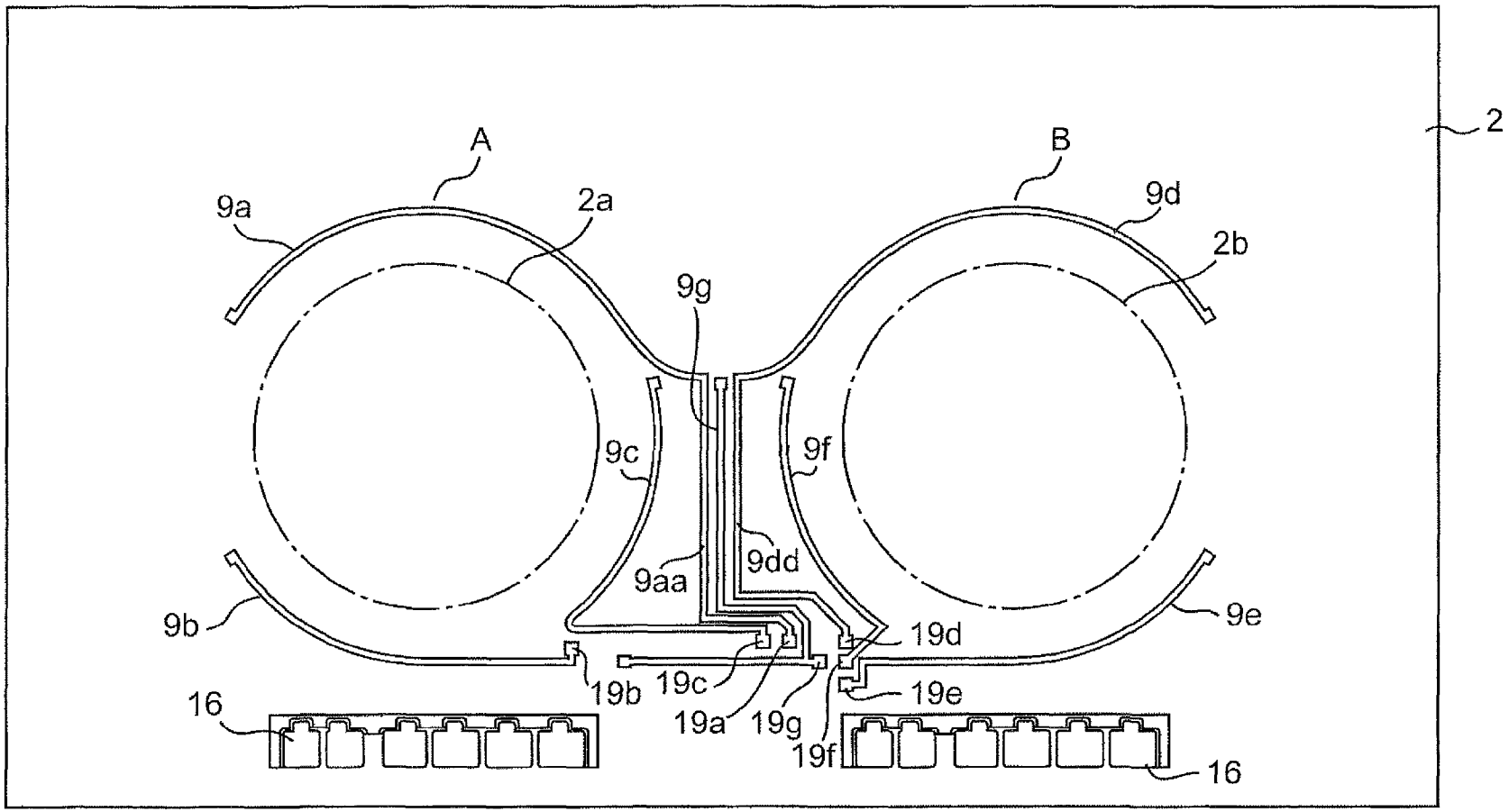
FIG. 2 is a plan view showing various kinds of electrodes formed in a top panel in the induction heating cooker in the first embodiment.

FIG. 2 is a plan view of the top panel 2 showing various kinds of electrodes which are formed on the back surface of the top panel 2 in the induction heating cooker in the first embodiment by printing a pattern of a conductive coating material and baking it at high temperature. The top panel 2 shown in FIG. 2 is formed of heat-resisting glass such as crystallized glass. Two circle patterns 2*a* and 2*b* are drawn and displayed on the surface of the top panel 2 so that a user can recognize a heating position on which the cooking container (such as a pan) 1 serving as an object to be heated is to be set, and each of them shows a position corresponding to an outer periphery of the heating coil 3 whose maximum output is 3 kW. In addition, a description will be given of the configuration having the two heating coils 3 in the first embodiment, but the number of the heating coils 3 is not limited to two, and any number such as one, three, or four of heating coils 3 may be used. The circle pattern and the electrodes are formed for at least one heating coil 3 according to the number of the heating coils 3.

As shown in FIG. 2, according to the top panel 2 of the induction heating cooker in the first embodiment, a plurality of operation electrodes 16 serving as operation switches through which the user sets an action of the induction heating cooker are printed on the back surface of the top panel 2 similar to the electrodes for detecting the boiling over. Positions of the operation electrodes 16 are provided in a region closer to the user than the circle patterns 2*a* and 2*b* in the top panel 2. In the following description, a side closer to the user in the top panel 2 is referred to as a front side, and an opposite side is referred to as a back side. In addition, the position in the top panel 2 is specified by referring to as right side and left side of the top panel 2, in the positions on the drawing shown in FIG. 2.

An electrode group A and an electrode group B composed of band-shaped electrodes 9 (boiling over detecting electrodes 9*a* to 9*g*) are formed adjacent to outer sides of the circle patterns 2*a* and 2*b*, that is, adjacent to peripheries of the heating coils 3 so as to be at predetermined distances from the circle patterns 2*a* and 2*b*, respectively. These electrode group A and electrode group B serve as state detecting electrodes for detecting the boiling over state.

In the neighborhood of the outer side of the left circle pattern 2*a* in the top panel 2 shown in FIG. 2, a left back electrode 9*a* having an arc-shaped portion along the ring-shaped circle pattern 2*a*, a left front electrode 9*b* having an arc-shaped portion along the circle pattern 2*a*, and a left center electrode 9*c* having an arc-shaped portion along the circle pattern 2*a* are formed on the left back side, left front side, and center side, respectively. Thus, the left circle pattern 2*a* is surrounded by the electrode group A composed of the left back electrode 9*a*, the left front electrode 9*b*, and left center electrode 9*c*. That is, the electrode group A has a radius larger than the circle pattern 2*a*, and arranged on a concentric circle of the circle pattern 2*a* or its neighborhood. In addition, connection portions 19*a*, 19*b*, and 19*c* each having a width larger than that of the arc-shaped portion are formed at one ends of the left back electrode 9*a*, the left front electrode 9*b*, and the left center electrode 9*c*, respectively. When the connection portions 19*a*, 19*b*, and 19*c* are connected to one end of a connection terminal 10*a* fixed to the electrostatic capacitance detecting portion 10 (refer to FIG. 1) which will be described below, the electrostatic capacitance detecting portion 10 is electrically connected to the electrodes 9*a*, 9*b*, and 9*c*. The connection portions 19*a*, 19*b*, and 19*c* are provided in the top panel 2, so that even when there is a little misalignment in mutual positional relationship between the connection terminal 10*a* and the connection portions 19*a*, 19*b* and 19*c* in mounting the top panel 2 on a body provided with the electrostatic capacitance detecting portion 10, the connection terminal 10*a* can be surely electrically connected to the connection portions 19*a*, 19*b*, and 19*c*.

Similarly, in the neighborhood of the outer side of the right circle pattern 2*b* also, the right back electrode 9*d* having an arc-shaped portion along the ring-shaped circle pattern 2*b*, the right front electrode 9*e* having an arc-shaped portion along the circle pattern 2*b*, and the right center electrode 9*f* having an arc-shaped portion along the circle pattern 2*b* are formed on the right back side, right front side, and center side, respectively. Thus, the right circle pattern 2*b* is surrounded by the electrode group B composed of the right back electrode 9*d*, the right front electrode 9*e*, and right center electrode 9*f*. That is, the electrode group B has a radius larger than the circle pattern 2*b*, and arranged on a concentric circle of the circle pattern 2*b* or its neighborhood. In addition, connection portions 19*d*, 19*e*, and 19*f* each having a width larger than that of the arc-shaped portion are formed at one ends of the right back electrode 9*d*, the right front electrode 9*e*, and the right center electrode 9*f*, respectively. The connection portions 19*d*, 19*e*, and 19*f* are provided in the top panel 2, so that similar to the connection portions 19*a*, 19*b*, and 19*c*, even when there is a little misalignment in mutual positional relationship between the connection terminal 10*a* and the connection portions 19*d*, 19*e* and 19*f* in mounting the top panel 2 on the body provided with the electrostatic capacitance detecting portion 10, the connection terminal 10*a* can be surely electrically connected to the connection portions 19*d*, 19*e*, and 19*f*.

A protective electrode 9*g* is provided in the center of the top panel 2, and it is provided between the left center electrode 9*c* and right center electrode 9*f*, and between a wiring pattern 9*aa* extending from the left back electrode 9*a* to the connection portion 19*a* and a wiring pattern 9*dd* extending from the right back electrode 9*d* to the connection portion 19*d*. In addition, the protective electrode 9*g* extends parallel to the operation electrode 16 on the front side of the center of the top panel 2. The protective electrode 9*g* also has a connection portion 19*g* at its end, and similar to the other electrodes, it serves as a connecting section which is connected to the one end of the connection terminal 10*a* of the electrostatic capacitance detecting portion 10 to be electrically connected to the electrostatic capacitance detecting portion 10.

In addition, the induction heating cooker in the first embodiment is provided with a temperature detecting portion 17 for detecting a temperature of the cooking container 1, and an operation portion 18 through which the user sets a heating condition of the induction heating cooker. A temperature signal of the cooking container 1 from the temperature detecting portion 17 and a set signal from the operation portion 18 are inputted to the control portion 8, and the inverter 4 having the switching element 4*a* is driven and controlled. Furthermore, the induction heating cooker in the first embodiment is provided with a display portion 20, so that the heating condition set by the user, or an action state of the induction heating cooker is displayed on it.

FIG. 1B is the circuit diagram showing the configuration of the electrostatic capacitance detecting portion 10 in the induction heating cooker in the first embodiment. As shown in FIG. 1A, the electrostatic capacitance detecting portion 10 has the connection terminal 10*a* having the one end which is connected to the electrode 9, a high-frequency signal generating portion 13 for supplying a high-frequency signal (such as 350 kHz) to each electrode 9, a capacitor 10*b* provided between another end of the connection terminal 10*a* and the high-frequency signal generating portion 13, a rectifying portion 14 connected to a connection point between the connection terminal 10*a* and a terminal of the capacitor 10*b*, for rectifying the high-frequency current supplied from the high-frequency signal generating portion 13 to each electrode 9 through the capacitor 10, and a voltage detecting portion 15 for detecting a DC voltage rectified by the rectifying portion 14. The connection terminal 10*a* is formed of a metal elastic body having preferable conductivity such as phosphor bronze having a contact portion plated with gold. Each of the connection portions (19*a* to 19*g*) of the electrodes 9 receives the high-frequency signal from the high-frequency signal generating portion 13 of the electrostatic capacitance detecting portion 10, and is electrically connected to the rectifying portion 14 to detect the electrostatic capacitance of each of the electrodes 9 (9*a* to 9*g*).

With the induction heating cooker in the first embodiment configured as described above, the pan serving as the cooking container 1 is set on the position shown by the circle pattern 2*a* or 2*b*, and the heating condition is set by the user through the operation portion 18, whereby the induction heating action is started. The control portion 8 drives and controls the inverter 4 so that the heating output reaches a first set value P1 (such as 3 kW) set by the operation portion 18 or automatically set by the control portion 8 in an automatic control mode. At a heating initial stage after the induction heating action has been started, there is no boiling over, and the top panel 2 serving as an electric insulator and air mainly exist between the electrode 9 and the cooking container 1, between the electrode 9 and the heating coil 3, and between the electrode 9 and a metal frame (not shown) provided around the top panel and grounded. Then, as the induction heating action continues, the contents in the heated cooking container 1 becomes a boiling state, that is, becomes a state in which the boiling over could be generated. Thus, when the boiling over is generated, a liquid containing an electrolyte exists around the electrode 9. For example, when the liquid spilt into a pan bottom spreads just above the electrode 9 or in its neighborhood, there is an increase in capacitive coupling between the electrode 9 and the pan bottom. As a result, there is an increase in electrostatic capacitance between the heating coil 3 opposed to the pan bottom and the electrode 9, so that capacitive coupling between the electrode 9 and the heating coil 3 becomes greater than that in the case where the boiling over is not generated. As a result, there is an increase in electrostatic capacitance in the electrode 9. As the boiling over state continues, the state of the increase in electrostatic capacitance varies depending on an amount of the boiling over and a state of the boiling over.

As described above, even when the temperature of the contents in the cooking container 1 reaches the boiling temperature, it is not necessary to detect the boiling over state before the boiling over starts, in the induction heating action. But after a certain time has elapsed after the heating start, and the contents continue to be in the boiling state, the boiling over could be generated, so that it is necessary to detect the boiling over state all the time. Thus, according to the induction heating cooker in the first embodiment, a time of 5 seconds is set as a certain time from the heating start for the contents until when the boiling over action starts, and the heating action is not stopped or the heating output is not reduced in the boiling over detecting action for this 5 seconds.

According to the induction heating cooker in the first embodiment, the boiling over detecting portion 11 detects the boiling over state on the basis of the electrostatic capacitance detecting signal (Vd) from the electrostatic capacitance detecting portion 10, the heating coil current detecting signal outputted from the heating coil current detecting portion 7*a*, and the input current detecting signal outputted from the input current detecting portion 7*b*.

Figure 3:
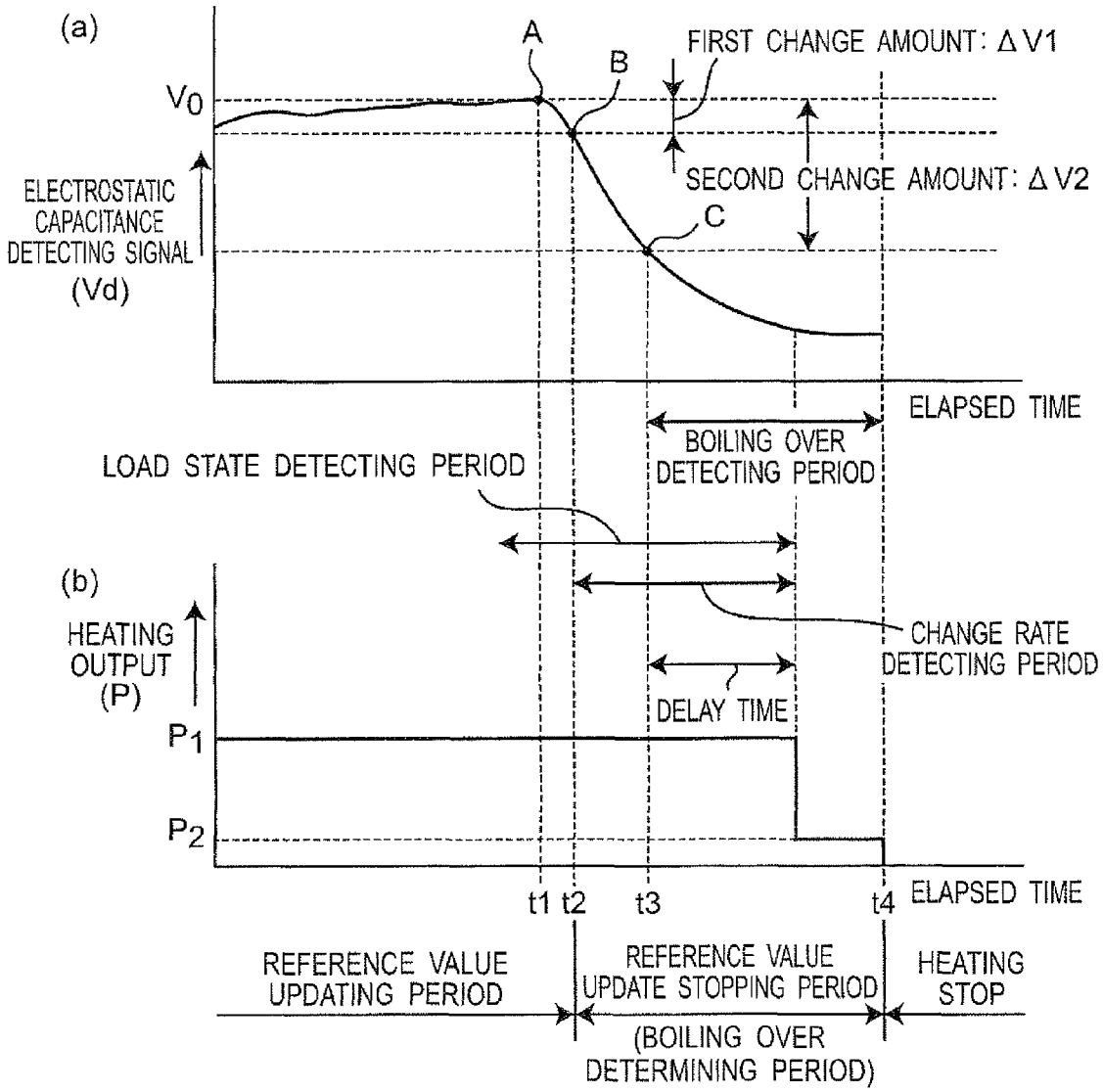
In FIG. 3, (a) is a view showing a detected electrostatic capacitance detecting signal, and (b) is a view showing one example of a heating output from an inverter in the induction heating cooker in the first embodiment.

FIG. 3 shows one example of the detected electrostatic capacitance detecting signal (Vd) ((a) of FIG. 3), and the heating output (P) outputted from the inverter 4 ((b) of FIG. 3) in the induction heating cooker in the first embodiment. Thus, (a) of FIG. 3 is a waveform diagram showing one example of the electrostatic capacitance detecting signal (Vd) inputted from the electrostatic capacitance detecting portion 10 to the boiling over detecting portion 11, and a longitudinal axis shows the electrostatic capacitance detecting signal (Vd) and a lateral axis shows an elapsed time in (a) of FIG. 3. In addition, (b) of FIG. 3 shows a relationship between the electrostatic capacitance detecting signal (Vd) shown in (a) of FIG. 3 and the heating output (P) from the inverter 4.

As shown in FIG. 1B, a capacitor 10*c* is formed between the electrode 9 and the common potential (ground potential) of the electrostatic capacitance detecting portion 10. Electrostatic capacitance of the capacitor 10*c* varies depending on arrangement of a conductor provided around the electrode 9. Hereinafter, the electrostatic capacitance of the capacitor 10*c* is also referred to as the "electrostatic capacitance of the electrode 9". Referring to FIG. 1B, a voltage Va of the high-frequency signal generating portion 13 is divided by the capacitor 10*b* and the capacitor 10*c*, rectified by the rectifier 14, and smoothed by the capacitor 10*d*, and it becomes a DC voltage (Vd'). The DC voltage (Vd') is inputted to the voltage detecting portion 15. The voltage detecting portion 15 converts the DC voltage (Vd') to an AC voltage, and outputs it to the boiling over detecting portion 11 as the electrostatic capacitance detecting signal (Vd). Thus, the electrostatic capacitance detecting portion 10 detects the electrostatic capacitance of the electrode 9, and outputs the electrostatic capacitance detecting signal (Vd) corresponding to its magnitude. In (a) of FIG. 3, the electrostatic capacitance detecting signal (Vd) reduces because the boiling over of the cooking container 1 is generated at a time t1 shown by a point A and there is an increase in electrostatic capacitance of any of the electrodes 9.

[Boiling Over Detecting Action]

Hereinafter, a description will be given of a boiling over detecting action in the state shown in (a) of FIG. 3.

First, the contents in the cooking container 1 does not boil over in an initial stage of the induction heating action to heat the cooking container 1 (not shown in (a) of FIG. 3), and a change due to the boiling over does not occur in the electrostatic capacitance detecting signal (Vd) detected by the voltage detecting portion 15 of the electrostatic capacitance detecting portion 10. As described above, the induction heating cooker in the first embodiment is configured such that the stop of the heating action or the reducing action of the heating output by the boiling over detecting action is not performed for the certain stand-by period (such as 5 seconds) from the start of the induction heating action. That is, only when it is determined that the boiling over is generated after the elapse of the stand-by period, the heating action is stopped or the heating output is reduced on the basis of the detected result of the boiling over detecting portion 11.

After the certain stand-by period (such as 5 seconds) has elapsed after the start of the induction heating action, the boiling over detecting action is started, so that the high-frequency voltage from each electrode 9 is rectified by the rectifying portion 14 and inputted to the voltage detecting portion 15. The DC voltage detected by the voltage detecting portion 15 is digitalized and outputted as the electrostatic capacitance detecting signal (Vd). There is a case where the electrostatic capacitance detecting signal (Vd) changes even when the boiling over is not generated. Therefore, in the induction heating action of the induction heating cooker in the first embodiment, the voltage detecting portion 15 outputs the electrostatic capacitance detecting signal (Vd) corresponding to the electrostatic capacitance of each electrode 9 to the boiling over detecting portion 11 every time a certain time (such as one cycle of a commercial power supply=16.7 msec or 20 msec) elapses, until the time t1 (point A).

The electrostatic capacitance detecting signal (Vd) may be inputted to the boiling over detecting portion 1 as it is every predetermined time (such as every time two zero points of the commercial power supply are detected=one cycle of the commercial power supply), or in a case where a noise is likely to be superimposed on the electrostatic capacitance detecting signal (Vd), an average value may be outputted as the electrostatic capacitance detecting signal (Vd) after it has been inputted predetermined times (such as 5 or 6) (every time such as about 0.1 sec). Thus, an average value of the electrostatic capacitance detecting signals (Vd) during a reference value detecting period (T0) (such as 1 second) is calculated, and the calculated average value is stored in the memory portion 12 as a reference value (V0). The reference value (V0) calculated as described above corresponds to the electrostatic capacitance detected by the electrostatic capacitance detecting portion 10 before the boiling over is generated. The boiling over detecting portion 11 executes arithmetic processing on the basis of a change amount (ΔV) of the electrostatic capacitance detecting signal (Vd) with respect to the reference value (V0), and determines whether or not the boiling over is generated.

In addition, the graph shown in (a) of FIG. 3 shows the electrostatic capacitance detecting signal (Vd) outputted from the voltage detecting portion 15, and this electrostatic capacitance detecting signal (Vd) behaves substantially similar to the electrostatic capacitance signal (Vc) used in the boiling over detecting portion 11, so that the electrostatic capacitance signal (Vc) will be described using the graph shown in (a) of FIG. 3 in the following description.

[Case where Change Amount of Electrostatic Capacitance Signal (Vc) is Less than First Change Amount (ΔV1)]

An electrostatic capacitance signal (Vc (1)) in the boiling over detecting portion 11 detected at the start of the boiling over detecting action is registered as the reference value (V0) in the memory portion 12 during the reference value detecting period (T0). In addition, as for the first reference value (V0), a previously set value may be used. Thus, an electrostatic capacitance signal (Vc (2)) detected for a second time is compared with the registered reference value (V0), and its change amount (ΔV (2)) is detected. When the detected change amount (ΔV (2)) is less than the previously set first change amount (reference value update stopping threshold value: ΔV1), the electrostatic capacitance signal (Vc (2)) at that time is registered in the memory portion 12 as the reference value (V0). Thus, an electrostatic capacitance signal (Vc (n)) is compared with the reference value (voltage signal) which is an electrostatic capacitance signal (Vc (n−1) detected at a previous time, and its change amount (ΔV) is detected and compared with the first change amount serving as the threshold value. Here, "Vc (n)" shows the electrostatic capacitance signal detected at the present time.

Therefore, when a change amount (ΔV (n)) of the electrostatic capacitance signal (Vc (n)) at the present time is less than the first change amount (ΔV1), the electrostatic capacitance signal (Vc (n)) at that time is registered in the memory portion 12 as the reference value (V0) and compared with the electrostatic capacitance signal (Vc (n+1)) detected at the next time. Thus, during a period in which the electrostatic capacitance signal (Vc) gradually changes, the updated reference value (V0) is always sequentially stored in the memory portion 12. In the boiling over detecting action, the above reference value updating action is sequentially performed, but when the change amount (ΔV (n)) reaches the reference value or more, the reference value updating action is stopped as will be described below. According to the induction heating cooker in the first embodiment, the first change amount (ΔV1) serving as the threshold value used for determining whether or not the reference value (V0) is updated and registered, that is, the reference value update stopping threshold value is set to "3 digits". Here, the "digit" shows a minimum unit of a digital display of a voltage or a time, and in this embodiment, since a power supply voltage of a microcomputer composing the voltage detecting portion 15 is 5 V, it shows 5 V/8 bit=about 19.5 mV.

As described above, during the normal induction heating action in which the boiling over is not generated, that is, while the electrostatic capacitance of the electrode 9 does not abruptly change, the latest electrostatic capacitance signal (Vc (n)) is compared with the updated and registered reference value (V0), and since the change amount is less than the first change amount (ΔV1: such as 3 digits), the electrostatic capacitance signal (Vc (n)) detected at that time is newly registered as the reference value (V0) and recorded in the memory portion 12 every time the reference value detecting period (T0) elapses. Thus, according to the induction heating cooker in the first embodiment, during the normal induction heating action, the detected electrostatic capacitance signal (Vc) is updated as the latest averaged reference value (V0) every reference value detecting period (T0).

[Case where Change Amount of Electrostatic Capacitance Signal (Vc) is First Change Amount ΔV1 or more]

Next, a description will be given of an action of the boiling over detecting portion 11 executed in a case where the electrostatic capacitance signal (Vc (n)) is compared with the reference value (V0), and its change amount reaches the first change amount (reference value update stopping threshold value: ΔV1) or more.

In the graph in (a) of FIG. 3, when the electrostatic capacitance detecting signal (Vd), that is, the electrostatic capacitance signal (Vc) exceeds the first change amount (ΔV1) shown by a point B (time t2), the induction heating cooker in the first embodiment enters the reference value update stopping period, and executes a reference value update stopping process to inhibit the above reference value updating process. That is, the detected electrostatic capacitance signal (Vc (n)) is compared with the previous electrostatic capacitance signal (Vc (n−1)) serving as the reference value and its change amount is the first change amount (ΔV1) or more, so that the previous electrostatic capacitance signal (Vc (n−1)) is kept registered as the reference value (V0) as it is. In (a) of FIG. 3, the reference value (V0) at the point A is fixed as the reference value. Therefore, the next electrostatic capacitance signal (Vc (n+1)) is compared with the previous electrostatic capacitance signal (Vc (n−1)) registered as the reference value (V0), and its change amount (ΔV (n+1)) is calculated. Thus, the reference value (V0) is fixed during the reference value update stopping period, and the change amount with respect to the fixed reference value (V0) is calculated. In the first embodiment, the reference value update stopping period is about 3 seconds.

In addition, during the reference value update stopping period (also referred to as a boiling over determining period) started from the time when the change amount of the electrostatic capacitance signal (Vc) with respect to the reference value (V0) exceeds the first change amount (ΔV1), when the electrostatic capacitance signal (Vc (n+1)) detected next is compared with the previously registered reference value (V0) and its change amount returns to within the first change amount (ΔV1), the reference value update stopping period is finished and the electrostatic capacitance signal (Vc (n+1)) detected at that time is newly registered as the reference value. Therefore, when the change amount of the electrostatic capacitance signal (Vc) exceeds the first change amount (ΔV1), the reference value update stopping period is started, but when the change amount of the electrostatic capacitance signal (Vc) newly detected during a certain detecting period (such as 1 second) is less than the first change amount (ΔV1), the boiling over detecting portion 11 determines it as the normal induction heating action and executes the reference value updating process during the reference value updating period.

[Case where Change Amount of Electrostatic Capacitance Signal (Vc) is Second Change Amount (ΔV2) or More]

As described above, during the reference value update stopping period (boiling over determining period), when the electrostatic capacitance signal (Vc (n)) detected at the present time is compared with the previously registered reference value (V0), and its change amount exceeds the first change amount (ΔV1) and reaches a second change amount (output reducing threshold value: ΔV2) or more (time t3), the induction heating cooker in the first embodiment enters a boiling over detecting period serving as a period lasting until the end of the reference value update stopping period. According to the induction heating cooker in the first embodiment, the output reducing threshold value, that is, the second change amount (ΔV2) serving as the threshold value used for determining whether or not the boiling over detecting period is started is "14 digits". Here, "14 digits" means about 0.27 V. In addition, as described above, "1 digit" means the minimum unit of the digital display. Thus, determination of the boiling over is established during the period between the time when the detected electrostatic capacitance signal (Vc (n)) at the present time with respect to the reference value (V0) exceeds the first change amount (output reducing threshold value: ΔV1) (time t2) and the end of the boiling over determining period (time t4).

According to the induction heating cooker in the first embodiment, during the boiling over detecting period, the heating output of the inverter 4 is reduced from the first set value (P1: such as 3 kW) registered when the condition of the induction heating action is set, to a second set value (P2: such as 300 W) (reduction in watt) after elapse of a delay period having a predetermined delay time such as 1.5 second, from the time when the change amount of the detected electrostatic capacitance signal (Vc (n)) with respect to the reference value (V0) reaches the second change amount (output reducing threshold value: ΔV2) or more.

During the boiling over detecting period, an electrostatic capacitance change rate, that is, gradient (transition) of the electrostatic capacitance detected during the boiling over detecting period is calculated. Here, the electrostatic capacitance change rate is a change amount of the electrostatic capacitance per unit time. When the calculated electrostatic capacitance change rate reaches a predetermined change rate (such as 145 digits/second) or more, the detected electrostatic capacitance in the electrode 9 abruptly increases, so that it is determined that the state of the boiling over is critical (the boiling over is highly likely to be generated), and the induction heating action is stopped, or the heating output of the inverter 4 is reduced to a third set value (P3: such as 0.1 kW).

In addition, during the boiling over detecting period, a determination is made on a magnitude of a state the boiling over (degree of boiling over), or a state other than the boiling over state (such as a state in which the cooking container 1 is shifted, the cooking container 1 is lifted, or a small article load is put on), on the basis of the calculated change rate of the electrostatic capacitance. During the boiling over detecting period, it is determined whether or not a parameter change in output such as an output current or an output voltage of the inverter 4 is a predetermined value or lower. As described above, under the condition that the heating output from the inverter 4 is reduced to the second set output (P2), unless the detected electrostatic capacitance shows a value rising by a predetermined value (such as 15 digits) or more with respect to a minimum electrostatic capacitance signal (Vc (min)), it is determined that a possibility of the boiling over is high, and the heating action may be stopped.

In addition, as another configuration, during the boiling over determining period (reference value update stopping period) started from the time when the detected electrostatic capacitance signal (Vc) exceeds the first change amount (ΔV1), when the electrostatic capacitance change rate showing the transition of the electrostatic capacitance in the detecting signal from at least one of the boiling over electrode (9*a* to 9*g*) reaches a predetermined value (such as 145 digits/second) or more, the induction heating action may be instantly stopped, or the heating output is considerably reduced to a third set value (such as 0.1 kW) which is further lower than the second set value.

The minimum electrostatic capacitance signal (Vc (min)) detected in the boiling over determining period (reference value update stopping period) is compared with the detected latest electrostatic capacitance signal (Vc(n)), and when the rising exceeding the predetermined value (such as 15 digits) is detected, it is determined that the boiling over state is not generated, and the reference value updating action is started again. This is because the electrostatic capacitance signal does not abruptly rise in the boiling over state (the electrostatic capacitance does not abruptly reduce).

In addition, during the boiling over determining period, relationships of the electrostatic capacitance signals of the three electrodes 9 (left back electrode 9*a*, left front electrode 9*b*, and left center electrode 9*c*, or right back electrode 9*d*, right front electrode 9*e*, and right center electrode 9*f*) for detecting the electrostatic capacitance with respect to the cooking container 1 set on the heating coil 3 are used as a determining substance for the boiling over detection. For example, when the electrostatic capacitance of the three electrodes 9 show different transitions (time change), the small boiling over could be generated, and when they show the same transition, the large boiling over could be generated, so that it is determined whether or not the heating output is instantly stopped.

As described above, according to the induction heating cooker in the first embodiment, during the boiling over determining period, in the case where the boiling over could be generated, the heating output is reduced (second set value: P2) after the elapse of the predetermined delay period, and when it is determined that the possibility of the boiling over is higher, on the basis of the electrostatic capacitance change rate, the heating output is further reduced (third set value: P3), or the heating output is stopped. In addition, when it is determined that the boiling over is generated, the induction heating action is surely stopped. This state is shown in (a) and (b) of FIG. 3. As shown in (a) and (b) of FIG. 3, when the change amount of the electrostatic capacitance signal (Vc) from the reference value (V0) reaches the first change amount (reference value update stopping threshold value: ΔV1) or more, the reference value updating period ends, and the reference value update stopping period is started. During the reference value update stopping period, the electrostatic capacitance signal (electrostatic capacitance voltage at the point A in (a) of FIG. 3) detected just before the start of the reference value updating stopping period is used as the reference value (V0). During the reference value update stopping period, when the detected electrostatic capacitance signal (Vc) exceeds the second change amount (output reducing threshold value: ΔV2), the boiling over determining period is started, and the heating output of the inverter 4 is reduced (to P2 such as 0.3 kW) after the elapse of the delay period. In addition, during this boiling over detecting period, when the electrostatic capacitance change rate reaches the predetermined value (such as 145 digits/second) or more, the heating output is further reduced (to P3: such as 0.1 kW), or the heating output is stopped. Then, during the boiling over detecting period, when the condition required for determining that the boiling over is generated is satisfied, and the boiling over determination is established, the heating output is surely stopped.

In addition, during the induction heating action of the induction heating cooker in the first embodiment, when the user changes the output (heat power) through the operation portion 18, the above-described boiling over detecting action is reset, and the boiling over detecting action is newly started. However, as for an initial stage of the newly set induction heating action, the certain time during which the heating output controlling action to stop the heating or reduce the heating output to the third heating output in the boiling over detecting action is not performed is set shorter (such as 3 seconds) than that at the time of the heating start. The certain time during which the boiling over detecting action is not performed in the initial stage is appropriately set according to its situation (such as output or temperature).

In addition, the boiling over detecting portion 11 of the induction heating cooker in the first embodiment detects the electrostatic capacitance of the electrode 9 several times during its detecting period (first predetermined time: such as 1 second), calculates the average value of the plurality of detected electrostatic capacitance, and compares the average value of the electrostatic capacitance with the reference value (V0) as described above, but as another configuration, among the electrostatic capacitance detected several times during the detecting period (such as 1 second), the electrostatic capacitance detected at the last time may be determined as the electrostatic capacitance in the detecting period and compared with the reference value (V0). In this configuration, even when the electrostatic capacitance detected in the detecting period largely fluctuates, the final latest electrostatic capacitance is compared with the reference value (V0), so that the state can be detected with high precision.

In addition, according to the induction heating cooker in the first embodiment, as another configuration, when the change amount of the plurality of electrostatic capacitance detected several times during the detecting period (first predetermined time: such as 1 second) with respect to the reference value (V0) reaches the reference value update stopping threshold value (3 digits) or more, the boiling over detecting portion 11 may stop updating the reference value (V0) with respect to the memory portion 12, reset the detecting period at that time, start to measure a new detecting period, and execute the reference value updating process with respect to the memory portion 12.

According to the induction heating cooker in the first embodiment, when the change amount of the electrostatic capacitance detected in any one of the electrodes 9 (9*a* to 9*g*) provided around the heating coil 3 with respect to the reference value (V0) is less than the reference value update stopping threshold value, the reference value updating process is executed, and when the change amount reaches the reference value update stopping threshold value or more, the reference value update stopping process is executed. Furthermore, according to the induction heating cooker in the first embodiment, when the change amount of the detected electrostatic capacitance reaches the output reducing threshold value (such as 14 digits) or more, the heating output of the inverter 4 is reduced (changed to set value P2), and when the electrostatic capacitance change rate reaches the predetermined value or more during the boiling over detecting period, the heating output of the inverter 4 is further reduced (changed to the set value P3).

As described above, the induction heating cooker in the first embodiment has the top panel 2 on which the cooking container 1 is set, the heating coil 3 provided under the top panel 2, for heating the cooking container 1 by induction, the inverter 4 for supplying the high-frequency current to the heating coil 3, the electrodes 9 provided on the back surface of the top panel adjacent to the periphery of the heating coil 3, the electrostatic capacitance detecting portion 10 for supplying the high-frequency signal to the electrodes 9 and detecting the electrostatic capacitance of the electrodes 9, the memory portion 12 for storing the detected electrostatic capacitance as the reference value, the control portion 8 for controlling the inverter 4 so that its heating output reaches the first set value (such as 3 kW or less), the boiling over detecting portion 11 for executing the reference value updating process to store the electrostatic capacitance in the memory portion 12 as the reference value when the electrostatic capacitance of the electrode 9 satisfies the predetermined condition, and executing the output controlling action to reduce the heating output of the inverter to the previously set second set value (such as 0.3 kW) or stop the heating action after the change amount of the electrostatic capacitance of the electrode with respect to the reference value (V0) reaches the output reducing threshold value (such as 14 digits) or more.

The boiling over detecting portion 11 in the induction heating cooker in the first embodiment stops the heating action, or reduces the heating output to the third set value (such as 0.1 kW) lower than the second set value when the change rate of the detected electrostatic capacitance reaches the predetermined change rate (such as 145 digits/second) or more, and sets the heating output to the first set value when the change rate of the detected electrostatic capacitance is less than the predetermined change rate, during a change rate detecting period (such as 1.5 second) including the time when the change amount of the electrostatic capacitance of the electrode 9 with respect to the reference value (V0) reaches the output reducing threshold value (such as 14 digits) or more.

In addition, according to the induction heating cooker in the first embodiment, the boiling over detecting portion 11 executes the output controlling action after the predetermined delay time started from the time when the change amount of the electrostatic capacitance of the electrode 9 with respect to the reference value (V0) reaches the output reducing threshold value (such as 14 digits) or more, and does not execute the output controlling action when it is determined that the boiling over is not generated during the delay time.

In addition, the induction heating cooker in the first embodiment includes the plurality of electrodes 9, and the boiling over detecting portion 11 sets the heating output to the first set value when the electrostatic capacitance change rate in any one of the electrodes reaches the predetermined change rate or more, and the change amounts of the other electrodes with respect to the reference value all reach a boiling over detecting canceling threshold value (such as 8 digits) or more which is set to be the output reducing threshold value or less.

Furthermore, according to the induction heating cooker in the first embodiment, the boiling over detecting portion 11 does not execute the output controlling action to be performed when the change amount of the electrostatic capacitance of the electrode 9 with respect to the reference value (V0) reaches the output reducing threshold value or more, in the case where the change in high-frequency current, high-frequency voltage, or input current of the inverter 4, or turn-on time of the switching element of the inverter 4 is not within the predetermined value, during the predetermined period including the time when the change amount of the electrostatic capacitance detected in the electrostatic capacitance detecting portion 10 with respect to the reference value (V0) reaches the output reducing threshold value (such as 14 digits) or more.

[Menu Display]

FIGS. 4A to 4E show states of menu display portions of the operation portion 18 and the display portion 20 in the induction heating cooker in the first embodiment, and show procedures to set the boiling over detecting action.

Figure 4A:
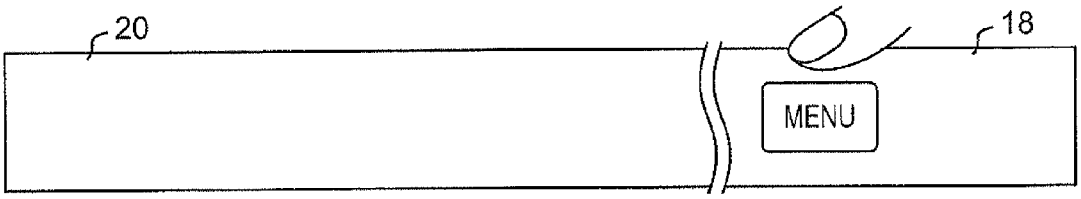
FIG. 4A is a view showing states of menu display portions of an operation portion and a display portion, and a view showing a setting procedure of a boiling over detecting action in the induction heating cooker in the first embodiment.
Figure 4B:
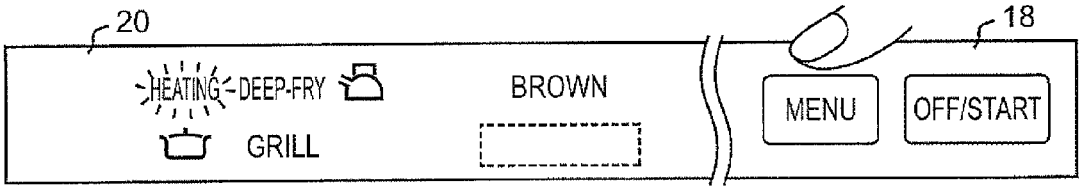
FIG. 4B is a view showing states of the menu display portions of the operation portion and the display portion, and a view showing a setting procedure of the boiling over detecting action in the induction heating cooker in the first embodiment.

FIG. 4A is a display state view of the menu display portions in the operation portion 18 and the display portion 20 when the user sets the heating condition before the start of the induction heating action of the induction heating cooker in the first embodiment. As shown in FIG. 4A, only the operation switch of "menu" is displayed on the menu display portion. When the user selects (presses) the "menu" mark, as shown in FIG. 4B, other than the "menu", "heating", "pan mark", "deep-fry", "grill", "kettle mark", "brown", and "off/start" are displayed. At this time, only the mark of the "heating" blinks.

When the "off/start" mark is selected (pressed) in the state shown in FIG. 4B, the induction heating action is started, and a brown detecting action is started. The brown detecting action is performed to detect a brown of the contents of the cooking container 1, and this is detected by a temperature detecting portion 17 on the basis of information, such as an abrupt temperature rise. During this induction heating action, only the brown detecting action is executed, and the boiling over detecting action is not started.

Figure 4C:
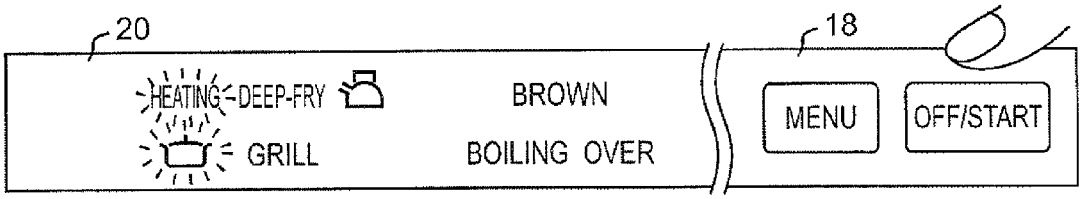
FIG. 4C is a view showing states of the menu display portions of the operation portion and the display portion, and a view showing a setting procedure of the boiling over detecting action in the induction heating cooker in the first embodiment.
Figure 4D:
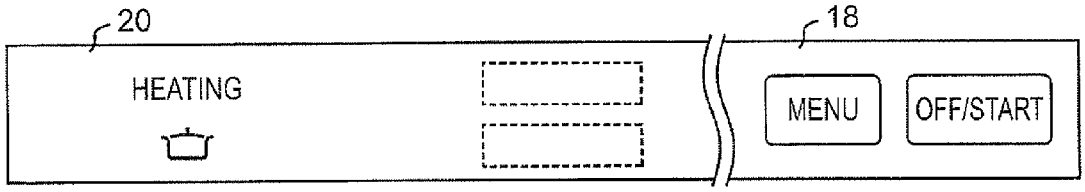
FIG. 4D is a view showing states of the menu display portions of the operation portion and the display portion, and a view showing a setting procedure of the boiling over detecting action in the induction heating cooker in the first embodiment.

When the "menu" mark is selected (pressed) in the state shown in FIG. 4B, the menu display portions are displayed as shown in FIG. 4C. As shown in FIG. 4C, a "boiling over" mark is newly displayed and the "heating" and the "pan mark" starts to blink, compared with the menu display portions shown in FIG. 4B. That is, when the user selects (presses) the "off/start" mark in this state, the induction heating action is started, and the brown detecting action and boiling over detecting action are started. FIG. 4D shows display states of the menu display portions during the induction heating action. As shown in FIG. 4D, during the induction heating action, the "heating", "pan mark", "menu", and "off/start" are displayed, so that the user can change the menu, or stop the induction heating action any time during the induction heating action.

Figure 4E:
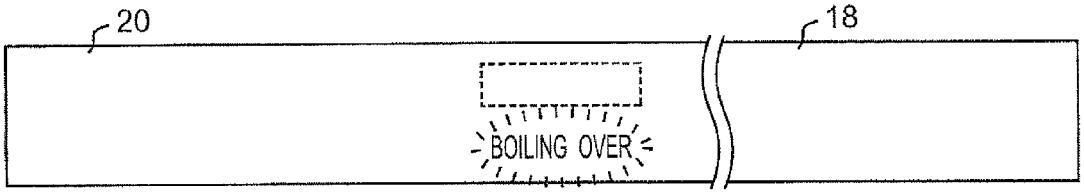
FIG. 4E is a view showing states of the menu display portions of the operation portion and the display portion, and a view showing a setting procedure of the boiling over detecting action in the induction heating cooker in the first embodiment.
Figure 5:
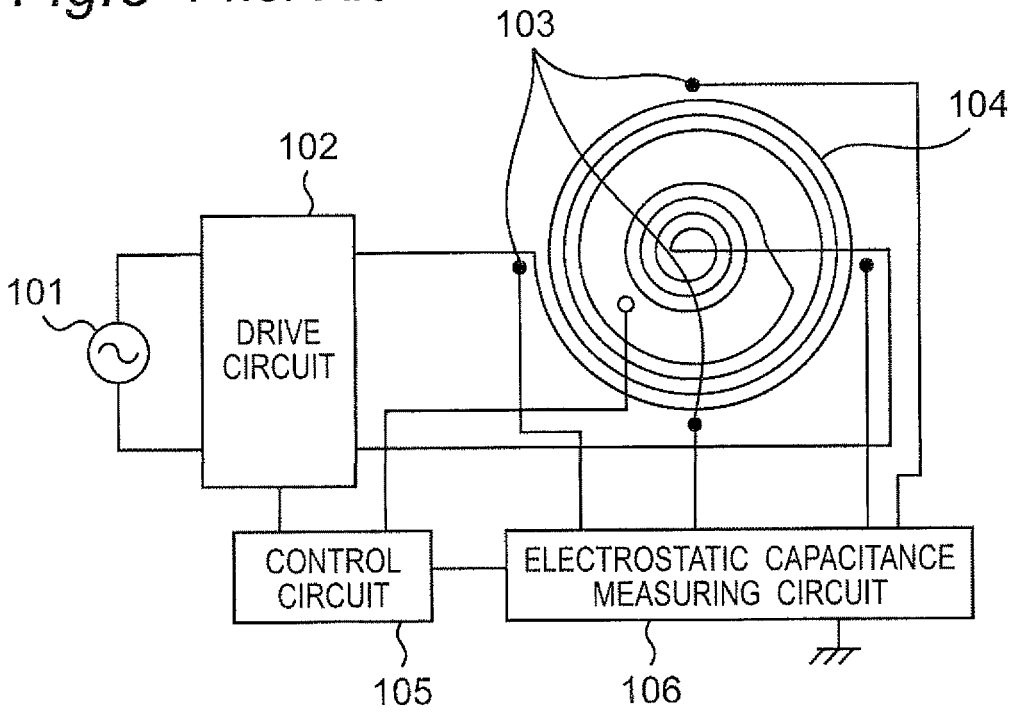
Fig.5 Prior Art
FIG. 5 is the block diagram showing the configuration of the conventional induction heating cooker.
Figure 6:
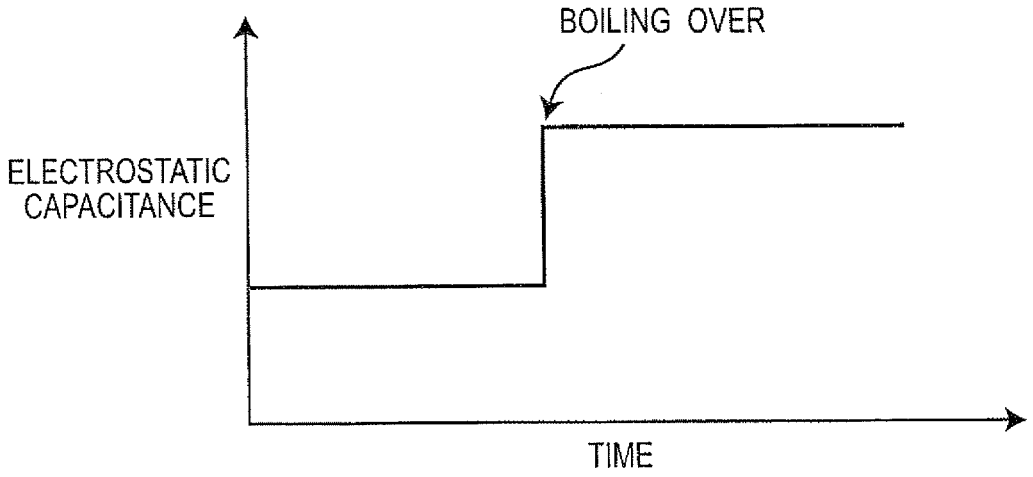
Fig.6 Prior Art
FIG. 6 is the graph showing the change in electrostatic capacitance in detecting boiling over in the conventional induction heating cooker.

As described above, during the induction heating action in which the boiling over detecting action is set, when the boiling over determination is established and it is determined that the boiling over is generated as a result of the above boiling over detecting action, the "boiling over" blinks in the menu display portion as shown in FIG. 4E. In addition, according to the induction heating cooker of the first embodiment, the "boiling over" blinks in the menu display portion when the boiling over is detected, but as another configuration, the user may be informed of the boiling over state with sound as well as the blink of the "boiling over".

In addition, in the menu display portion in the induction heating cooker in the first embodiment, every time the mark of the "menu" is pressed and selected, the "deep-fry", "grill", "kettle mark", and "heating" sequentially blinks after the "heating", and the object to be heated is selected. In addition, the "kettle mark" shows a boiling action to boil water.

In addition, the operation portion 18 in the induction heating cooker in the first embodiment is provided with operation switches (arrow marks showing right and left movements, marks showing increase and decrease (+, −)) required in the induction heating cooker for selecting the heater, setting a temperature (adjust heat power), and setting a timer.

As described above, according to the induction heating cooker in the present invention, as specifically described in the embodiment, since the change amount and the change rate of the electrostatic capacitance generated in the electrode are detected with high precision, on the basis of the signals from the arc-shaped electrodes provided on the back surface of the top panel adjacent to the periphery of the heating coil, it becomes possible to considerably reduce the erroneous detection of the boiling over of the cooking container generated during the induction heating action, and the generation of the boiling over can be surely detected, so that the induction heating cooker is high in reliability.

INDUSTRIAL APPLICABILITY

It becomes possible to provide the highly reliable induction heating cooker capable of considerably reducing the erroneous detection of the boiling over of the cooking container generated during the induction heating action, in the market.

The invention claimed is:

1. A method for operating an induction heating cooker comprising:

a top panel for mounting a cooking container;

a heating coil provided under the top panel, for heating the cooking container by induction;

an inverter for supplying a high-frequency current to the heating coil;

an electrode provided on a back surface of the top panel adjacent to a periphery of the heating coil;

an electrostatic capacitance detecting portion configured to supply a high-frequency signal to the electrode and detect an electrostatic capacitance of the electrode;

a memory portion configured to store the detected electrostatic capacitance as a reference value;

a control portion that controls the inverter such that heating output of the inverter reaches a first set value; and a boiling over detecting portion configured to execute a reference value updating process and store the electrostatic capacitance in the memory portion as a reference value when the electrostatic capacitance of the electrode satisfies a predetermined condition, the method comprising:

after a predetermined delay time, the boiling over detecting portion further executes an output controlling action to reduce the heating output of the inverter to a predetermined second set value or stops a heating action, when a change amount of the electrostatic capacitance of the electrode with respect to the reference value is equal to or greater than an output reducing threshold value, wherein the delay time is the time when the change amount of the electrostatic capacitance with respect to the reference value is equal to or greater than the output reducing threshold value, and does not execute the output controlling action when it is determined that the boiling over is not generated during the delay time, and wherein the boiling over detecting portion stops the heating action or reduces the heating output to a third set value lower than the second set value when a change rate of the detected electrostatic capacitance is equal to or greater than a predetermined change rate, and returns the heating output to the first set value when the change rate of the detected electrostatic capacitance is less than the predetermined change rate, during a change rate detecting period that includes a time when the change amount of the electrostatic capacitance of the electrode with respect to the reference value is equal to or greater than the output reducing threshold value.

2. The method of operating an induction heating cooker according to claim 1, wherein the boiling over detecting portion detects the electrostatic capacitance of the electrode a plurality of times during a first predetermined time, and calculates the change rate with the change amount of an average value of the plurality of detected electrostatic capacitance with respect to the reference value.

3. The method of operating an induction heating cooker according to claim 1, wherein the boiling over detecting portion updates the electrostatic capacitance detected during a first predetermined time and stores it in the memory portion as the reference value when the change amount of the electrostatic capacitance detected during the first predetermined time with respect to the reference value is less than a reference value update stopping threshold value smaller than the output reducing threshold value, and stops the update of the reference value to the memory portion when the change amount of the electrostatic capacitance detected during the first predetermined time with respect to the reference value is equal to or greater than the reference value update stopping threshold value.

4. The method of operating an induction heating cooker according to claim 1, wherein the boiling over detecting portion detects the electrostatic capacitance of the electrode a plurality of times during a first predetermined time, and updates an average value of the plurality of electrostatic capacitance detected in the first predetermined time and stores it in the memory portion as the reference value when the change amount of an average value of the plurality of detected electrostatic capacitance with respect to the reference value is less than the reference value update stopping threshold value.

5. The method of operating an induction heating cooker according to claim 1, wherein the boiling over detecting portion detects the electrostatic capacitance of the electrode a plurality of times during a first predetermined time, and stops the update of the reference value to the memory portion when the change amount of an average value of the plurality of detected electrostatic capacitance with respect to the reference value is equal to or greater than the reference value update stopping threshold value.

6. The method of operating an induction heating cooker according to claim 1, wherein the induction heating cooker further comprises a plurality of electrodes, and wherein the boiling over detecting portion returns the heating output to the first set value when the change rate of the electrostatic capacitance in any one of the electrodes is equal to or greater than the predetermined change rate, and the change amounts of other electrodes with respect to the reference value all are equal to or greater than a boiling over detecting canceling threshold value that is lower than the output reducing threshold value.

7. The method of operating an induction heating cooker according to claim 1, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

8. The method of operating an induction heating cooker according to claim 2, wherein the boiling over detecting portion executes the output controlling action after a predetermined delay time from the time when the change amount of the electrostatic capacitance of the electrode with respect to the reference value is equal to or greater than the output reducing threshold value, and does not execute the output controlling action when the boiling over is not generated during the delay time.

9. The method of operating an induction heating cooker according to claim 3, wherein the boiling over detecting portion executes the output controlling action after a predetermined delay time from the time when the change amount of the electrostatic capacitance of the electrode with respect to the reference value is equal to or greater than the output reducing threshold value, and does not execute the output controlling action when the boiling over is not generated during the delay time.

10. The method of operating an induction heating cooker according to claim 4, wherein the boiling over detecting portion executes the output controlling action after a predetermined delay time from the time when the change amount of the electrostatic capacitance of the electrode with respect to the reference value is equal to or greater than the output reducing threshold value, and does not execute the output controlling action when it is determined that the boiling over is not generated during the delay time.

11. The method of operating an induction heating cooker according to claim 5, wherein the boiling over detecting portion executes the output controlling action after a predetermined delay time from the time when the change amount of the electrostatic capacitance of the electrode with respect to the reference value is equal to or greater than the output reducing threshold value, and does not execute the output controlling action when it is determined that the boiling over is not generated during the delay time.

12. The method of operating an induction heating cooker according to claim 2, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

13. The method of operating an induction heating cooker according to claim 3, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

14. The method of operating an induction heating cooker according to claim 4, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

15. The method of operating an induction heating cooker according to claim 5, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

16. The method of operating an induction heating cooker according to claim 6, wherein the boiling over detecting portion does not execute the output controlling action to be performed when the change amount of the electrostatic capacitance of the electrode with respect to the reference value is equal to or greater than the output reducing threshold value, in a case where a change in high-frequency current, high-frequency voltage, or input current in the inverter or an turn-on time of a switching element of the inverter is not within a predetermined value, during a predetermined period including the time when the change amount of the electrostatic capacitance detected by the electrostatic capacitance detecting portion with respect to the reference value is equal to or greater than the output reducing threshold value.

* * * * *